US006530435B1

(12) United States Patent
Lindsay

(10) Patent No.: US 6,530,435 B1
(45) Date of Patent: Mar. 11, 2003

(54) APPARATUS FOR A HAND-HELD PNEUMATIC IMPACT TOOL

(76) Inventor: Steven James Lindsay, 3714 W. Cedar Hills Dr., Kearney, NE (US) 68845

( * ) Notice: Subject to any disclaimer, the term of this patent is extended or adjusted under 35 U.S.C. 154(b) by 64 days.

(21) Appl. No.: 09/749,155

(22) Filed: Dec. 27, 2000

(51) Int. Cl.[7] ..... B25D 9/14

(52) U.S. Cl. ..... 173/115; 173/128; 173/206; 173/207; 173/30

(58) Field of Search ..... 173/206, 207, 173/128, 115, 30

(56) References Cited

U.S. PATENT DOCUMENTS

| | | | | |
|---|---|---|---|---|
| 1,691,372 A | * | 11/1928 | Bayles | 173/16 |
| 3,393,755 A | | 7/1968 | Glaser et al. | |
| 4,030,556 A | | 6/1977 | Phillips | |
| 4,416,338 A | * | 11/1983 | Nelson et al. | 173/134 |
| 4,502,824 A | * | 3/1985 | Dohse et al. | 409/234 |
| 4,694,912 A | | 9/1987 | Glaser | |
| 5,203,417 A | | 4/1993 | Glaser | |
| 5,419,403 A | * | 5/1995 | Klemm | 173/115 |
| 5,449,044 A | | 9/1995 | Phillips | |
| 5,515,930 A | | 5/1996 | Glaser | |
| 5,803,183 A | | 9/1998 | Phillips | |
| 5,930,899 A | * | 8/1999 | Hartman et al. | 30/168 |
| 6,021,574 A | | 2/2000 | Murray | |
| 6,085,850 A | | 7/2000 | Phillips | |
| 6,095,256 A | | 8/2000 | Lindsay | |

* cited by examiner

*Primary Examiner*—Scott A. Smith
*Assistant Examiner*—Brian Nash

(57) ABSTRACT

An apparatus for a hand-held pneumatic impact tool for use in fine hand working operations includes a handpiece, a foot-operated flow control valve with exhaust and two hand operated flow control valves. The handpiece includes a housing having a cavity and annular shoulder accommodating a stepped piston dividing the cavity into three chambers. The control apparatus provides control for a hand-held pneumatic impact tool that will return an impacting handpiece to a fine oscillation idling state quickly when the user releases the foot-operated flow control valve. The apparatus also provides ease of control for adjusting the idling ready state of the handpiece to a faint oscillation idle.

5 Claims, 4 Drawing Sheets

APPARATUS FOR A HAND-HELD PNEUMATIC IMPACT TOOL

BACKGROUND OF THE INVENTION

1. Field of Invention

This invention relates to an improved controlling apparatus for an air impact tool over my prior patent, U.S. Pat. No. 6,095,256 issued Aug. 1, 2000. More specifically, this invention relates to an apparatus for a hand-held pneumatic impact power tool for delicate hand engraving and stone setting in the hand engraving and jewelry fields.

2. Description of Prior Art

Traditionally the tool used (and for a large part still used) for hand engraving and stone setting is a palm push graver tool. This traditional hand engraving tool consisted of the working point or graver set into a wood handle that fit comfortably into the palm of the hand. A problem that arises with this traditional tool is that as the graver point is pushed through a cut, even in very fine engraving cuts, there is a small loss of control due to the force that is exerted. The outcome of this loss of control can be the graver point exiting out of the cut and the exerted force on the tool will cause slippage across the work. For heavier engraving cuts, engravers and stone setters have used a small hand-held hammer to strike against the graver to drive it through a cut. This has helped with some of the problem described above, as it is unnecessary to exert a great deal of force when the hammer does the work. A disadvantage with this hand-held hammer method is it leaves the engraving cuts jagged with small flats caused by each hammer impact.

In recent times impact power tools have been developed to attempt to aid the jeweler and engraver. For example, U.S. Pat. No. 4,694,912 (1987) and U.S. Pat. No. 5,203,417 (1993) both to Glaser, use compressed air through a rotary valve to generate pulses of air. This is used to move a piston in the hand-held device forward, depressing a spring and at the same time impacting the graver holder. This design has an adverse effect of loss of power or no power at all when the piston floats, caused when the pulses of air do not give the return spring time to return the piston. This is caused by the frequency of the air pulses being too close together and/or by too much air pressure in each pulse. Moreover, previous hand-held engraving impact tools such as U.S. Pat. No. 3,393,755 to Glaser and Rohner (1968) have required a separate, specialized source of vacuum air pulses to the hand-held device. In the case of U.S. Pat. No. 4,694,912 to Glaser (1987) described above, a specialized rotary valve and an electric motor to rotate the valve is required to provide a source of air pulses to the hand-held impact device.

Patent U.S. Pat. No. 5,515,930 to Glaser (1996) discloses a hand-held pneumatic apparatus. This hand-held impact tool also uses a spring, similar to the impact tools described above, for the return stroke of the piston. This spring has an unfavorable effect to the range of impacts that can be achieved with the device, as enough air pressure must be used to compress the spring sufficiently to enable the piston to come into contact with the graver holder or anvil. A spring that is very light in strength can be used and finer impacts will be achieved, but this results in insufficient high impact power when the user desires greater impact energy. On the other hand, if a stronger spring is used, air pressure will need to be increased to supply enough force to depress the heavier spring and this additional pressure will cause the piston to travel with more velocity and consequently the user discovers that the tool cannot achieve fine low power impacts, but only high power impacts. It should be noted that this described strength of spring and range of impacts problem also exists with impact tool disclosed in U.S. Pat. No. 4,694,912 to Glaser (1987). Returning to U.S. Pat. No. 5,515,930 to Glaser (1996), this device also requires a special pressure-sensing element within the foot valve to start the piston oscillating by giving a quick surge of higher air pressure. This is needed as the tool's housing and tip will vibrate excessively if the tool housing or tool tip is not held against a fixed work surface while the device is oscillating and therefore requires the tool to start after the tool tip is placed against the work with the surge of higher air pressure. This vibration on an operator's hand can quickly fatigue the hand and can also make it difficult and impractical to place the tool tip where desired to begin an engraving cut. In addition, the vibration can dull the tool tip or ruin the work if the user attempts to place the tool tip to the work while the device is oscillating. This tool therefore requires its tip to be set into the work before starting the oscillation and therefore requires the special sensing element to help it start with a surge of air pressure. The air pressure surge to start the oscillation can also cause a surge of harder impacts than desired, making fine engraving work impractical.

In more recent times I disclosed a pneumatic impact handpiece and controlling invention in U.S. Pat. No. 6,095,256 to Lindsay (2000). This patent depicts a hand-held pneumatic impact tool that is not dependant on a spring for the piston's return or impact stroke. It also provides a hand-held pneumatic impact tool that will begin oscillation without requiring a surge of air pressure over the normal operating idling ready-state air pressure. However, in order to improve the ability of the impacts to cease quickly when a user releases the foot valve, an air exhaust is needed to lower air pressure quickly between the foot valve and handpiece. Also, it is difficult for a user to set the fine settings to allow the invention to idle at a fine oscillation.

BRIEF SUMMARY OF THE INVENTION

In accordance with the present invention a control apparatus for a hand-held pneumnatic impact tool comprises a handpiece, a foot-operated air flow valve with venting exhaust and two hand-controlled flow valves.

Objects and Advantages

This invention utilizes the same pneumatic handpiece as my earlier invention, U.S. Pat. No. 6,095,256 issued Aug. 1, 2000, but uses additional and modified valves in the control apparatus that significantly improve the performance characteristics as well as the ease of operation of the device. One of the handpiece embodiments disclosed in my earlier invention, U.S. Pat. No. 6,095,256 issued Aug. 1, 2000, has been included in the drawings and text in this patent to help illustrate the present invention of an improved apparatus for controlling such a pneumatic impact tool.

The principal objectives of this invention are to provide a control apparatus for a hand-held pneumatic impact tool that will return the impacting handpiece to the fine idling state quickly by ceasing to impact quickly when the user releases the foot valve; and to provide an apparatus for a hand-held pneumatic impact tool in which the idling ready-state of the handpiece can be adjusted easily for faint oscillation idling.

Other objects and advantages of my invention are:

(a) to provide a control apparatus for use with a hand-held pneumatic impact tool similar in size and shape to the traditional palm push engraving tool;

(b) to provide a control apparatus for a hand-held pneumatic impact tool with superb control of ultra fine impacts;

(c) to provide a control apparatus for a hand-held pneumatic impact tool in which the idling ready-state can be controlled by the user's preference and needs;

Still further objects and advantages of the invention will become apparent from a consideration of the drawing and ensuing description.

BRIEF DESCRIPTION OF THE DRAWINGS

Embodiments of the present invention are described below with reference to attached drawing figures, wherein.

DETAILED DESCRIPTION OF THE PREFERRED EMBODIMENT

Figure 1:
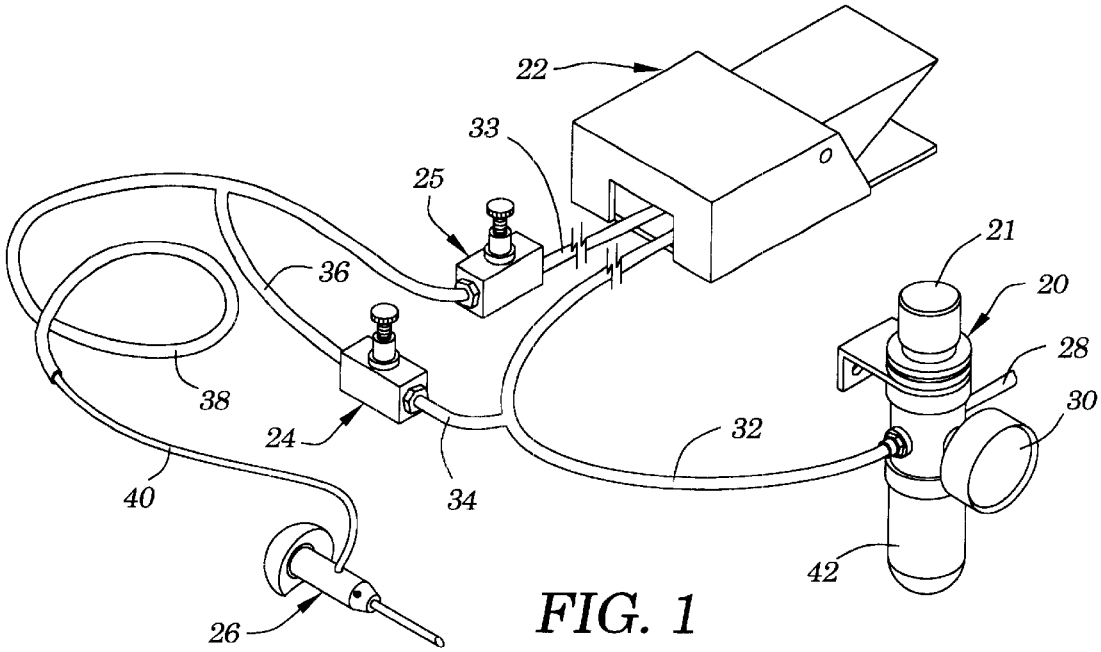
FIG. 1 is a perspective view of an apparatus for a hand-held pneumatic impact tool in accordance with the present invention.

A hand-held pneumatic impact tool apparatus in accordance with the present invention is illustrated in FIG. 1. The apparatus includes an air supply line 28, a hand operated pressure regulator assembly 20, a foot-operated flow control valve assembly 22, a distribution line 32 extending between the hand operated pressure regulator assembly 20 and the foot-operated flow control valve assembly 22, an impact handpiece 26, an outlet line 33 between the foot-operated flow control valve assembly 22 and a second flow valve 25, a delivery line 38 and reduced diameter delivery line 40 extending between the second flow valve 25 and the handpiece, and a idle flow valve 24 spliced between the distribution line 32 and delivery line 38 via lines 34 and 36.

The air supply line 28 connects the pressure regulator assembly 20 to a source of pressurized air, such as a conventional air compressor. The pressure regulator assembly 20 includes an inlet connected to the supply line 28, an outlet connected to the distribution line 32, and a valve for regulating air flow between the inlet and the outlet. In addition, the pressure regulator assembly 20 includes a pressure-sensing element for sensing the pressure of the air distributed from the regulator and for controlling the regulator to limit the pressure of the distributed air. A hand-operated knob 21 is connected to the pressure regulator assembly 20 for adjusting the regulated pressure distributed by the regulator. A gauge 30 is provided on the regulator to monitor the pressure being distributed. An additional element of the pressure regulator assembly is an air-cleaning filter 42 to filter the air that passes through the regulator.

Figure 7:
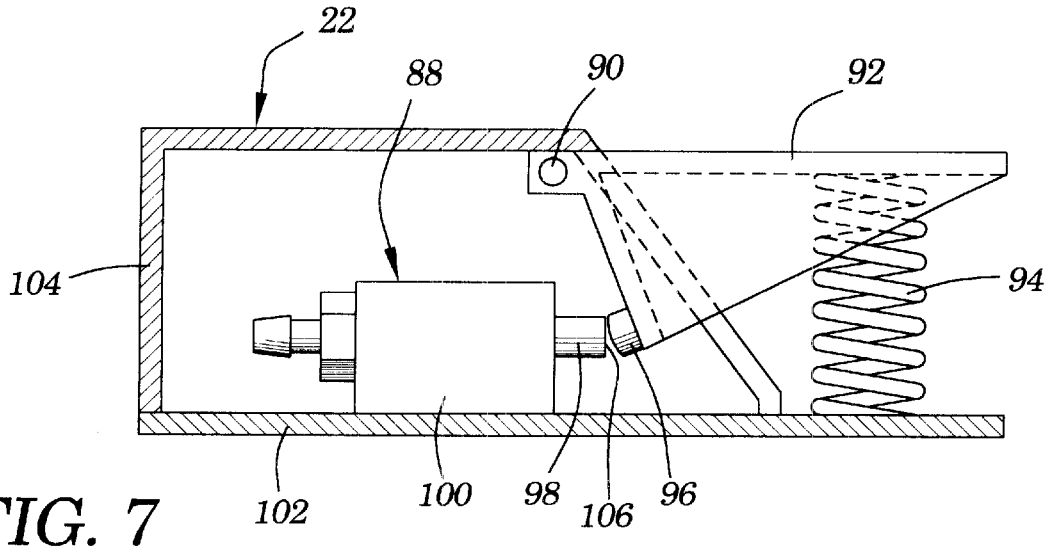
FIG. 7 is a side sectional view of a foot-operated flow control valve assembly in accordance with the present invention.
Figure 8:
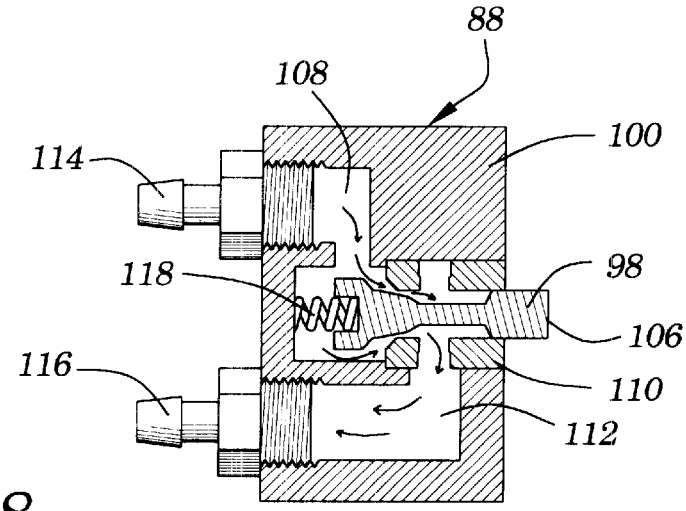
FIG. 8 is a top sectional view of an air flow valve contained in the foot-operated flow control valve assembly illustrated in FIG. 7 with the plunger depressed.
Figure 9:
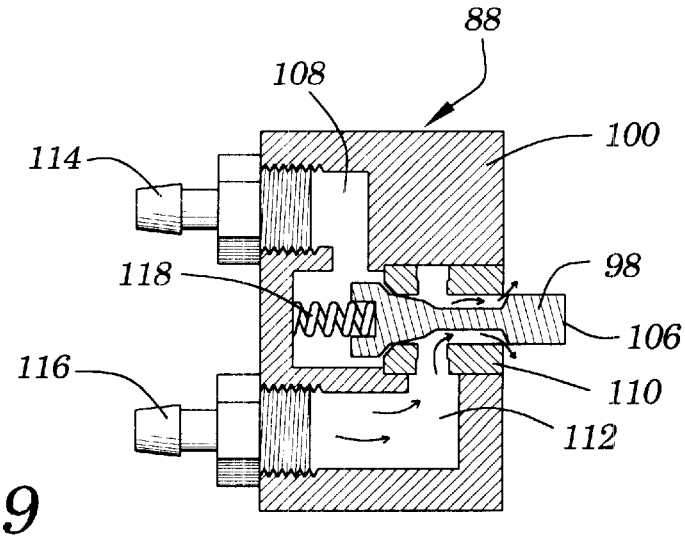
FIG. 9 is the same view as FIG. 8, differing in that the plunger is not depressed.

The foot-operated flow control valve assembly 22 is illustrated in a sectional view in FIG. 7. A flow control valve 88 is firmly attached to a base 102. A foot pedal 92 is attached to a housing 104 by a pivot pin 90 permitting the foot pedal to pivot when the user depresses the pedal with his or her foot. A compression spring 94 is place between the base 102 and underside of the foot pedal to return the foot pedal to the original position when the user takes his or her foot off. Referring to the top sectional view of the flow control valve 88 in FIG. 8 and FIG. 9, a plunger holder 10 has a secured, airtight fit into a valve housing 100. A plunger 98 has a tapered shape within the two ends of the plunger. Depending on the position of plunger 98, two chambers 112 and 108 within the housing 100 can become in communication with each other. When the foot pedal is not depressed, as in FIG. 9 a spring 118 will push plunger 98 out until the taper on the plunger 98 mates with the taper in plunger holder 110 closing off communication and air flow between chambers 112 and 108. With the plunger in this non-depressed position the plunger is permitted to be pushed just far enough out of the plunger holder 110 to permit communication between chamber 112 and the atmosphere, thus releasing air pressure from chamber 112. In FIG. 7 a protrusion 96 is firmly attached to the foot pedal 92. When the foot pedal is depressed, the protrusion 96 will press against plunger face 106 pushing the plunger into the flow control valve 88 and as a result push the plunger away from the mating taper within the plunger holder opening a communication passageway between chambers 112 and 108, illustrated in FIG. 8 and at the same time shutting off communication between chamber 112 and the atmosphere. The further the user depresses the foot pedal, the larger the opening between the mating taper surfaces of the plunger and the plunger holder become, permitting more air to flow between chambers 108 and 112. Referring to FIG. 1 and FIG. 8, chamber 108 is connected and is in communication with the distribution line 32 with a screw-in barb connector 114. Chamber 112 is connected and is in communication with the outlet line 33 with a screw-in barb connector 116.

Figure 6:
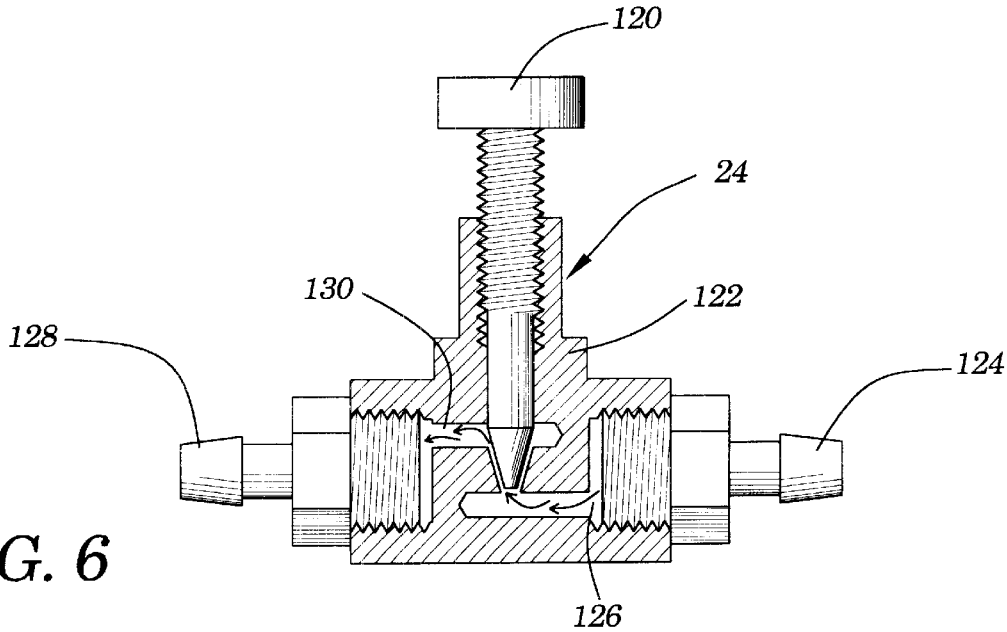
FIG. 6 is a sectional view of a flow valve in accordance with the present invention.

Referring to FIG. 1, idle flow valve 24 and second flow valve 25 are identical types of valves. The idle flow valve 24 is illustrated in a sectional in FIG. 6. Referring to FIG. 6, an adjusting screw 120 has a taper on the end that when threaded all the way into housing 122 will fit against a mating taper in housing 122. This tapered hole within housing 122 intersects a portion of each of chamber 126 and chamber 130. When the adjusting screw 120 is threaded all the way into housing 122 it will block communication and air flow between chambers 126 and 130. When the adjusting screw 120 is threaded out it will open communication between the chambers permitting air flow. The more the adjusting screw 120 is threaded out the more the air flow between the chambers. Both of the chambers 126 and 130 have screw-in barb connectors 124 and 128 for attaching air lines. Referring to FIG. 1 and FIG. 6, the second flow valve 25 is connected so that chamber 126 is in communication with outlet line 33 and so that chamber 130 is in communication with delivery line 38. Referring to FIG. 1 and FIG. 6, the idle flow valve 24 is connected so that chamber 126 is in communication with line 34, which is spliced into and in communication with the distribution line 32. Chamber 130 is in communication with line 36, which is spliced into and in communication with the delivery line 38.

Figure 2:
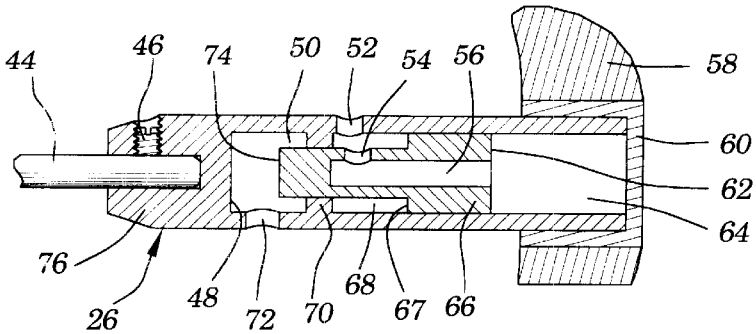
FIG. 2 is a sectional view of a hand-held pneumatic impact tool constructed in accordance with the present invention.

An impact handpiece 26, is illustrated in FIG. 2 and includes a cylindrical housing 76 with a cavity and an annular shoulder 70 accommodating a two-step piston 66 that can move axially within the housing cavity and dividing the cavity into the following three chambers:

- a head chamber 50 defined by the front piston face 74, the cavity bottom face 48, the walls of the housing, and one side of the annular shoulder 70. This head chamber constantly communicates with the atmosphere through the housing exhaust port 72;
- a central chamber 68 defined by the piston step end face 67, the external diameter of the smaller step of the piston, the walls of the housing, and one side of the annular shoulder 70. In addition the annular shoulder 70 separates this central chamber from the head chamber. This central chamber constantly communicates with the compressed air source through housing intake port 52;
- a rear chamber 64 defined by the rear piston face 62, an end cap 60, and the walls of the housing. Depending on the position of the piston relative to the housing, this rear chamber periodically communicates with a compressed air source through passage 56, piston port 54, and housing intake port 52, or with the atmosphere through passage 56, piston port 54, and housing exhaust port 72.

Tool tip 44 is held in the handpiece housing 76 by tightening setscrew 46. A handle 58 is comfortably shaped to fit into the palm of the hand and to provide bottom clearance as the tool is used over the work. The handle 58 is fixed onto the end cap 60. The end cap 60 in turn fits onto the housing 76 with an airtight seal. It should be noted that it is not shown in the illustrations, but a gasket, O-ring, or equivalent can be used between the housing 76 and end cap 60 to help provide an airtight seal together with a setscrew or other method to hold the end cap on the housing.

Operation

Figure 3:
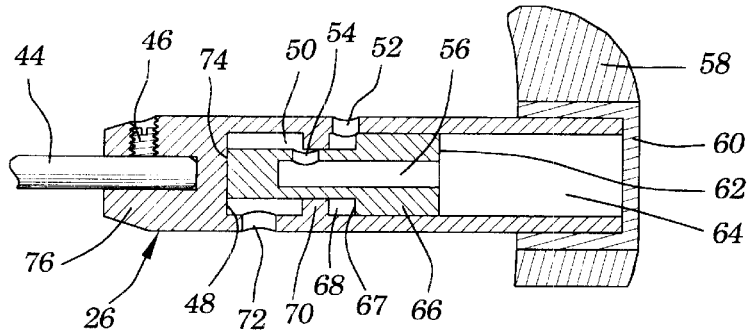
FIG. 3 is the same view as FIG. 2, differing in that the piston is occupying the extreme forward position.

The control apparatus for a hand-held pneumatic impact tool operate together as follows. Referring to FIG. 2, when compressed air is introduced to the housing intake port 52 and piston 66 is in apposition illustrated in FIG. 2, compressed air will fill the central chamber 68 and also the rear chamber 64 via piston port 54 and passage 56. The air pressure in the central chamber will attempt to push the piston further to the rear of the tool by pressing against the piston step end face 67, but the air pressure in the rear chamber 64 will attempt to push the piston in the opposite direction toward the front of the cavity by pressing against the rear piston face 62. Because the surface area of the rear piston face 62 is greater than the surface area of piston step end face 67, the piston will shift toward the front of the cavity until the front piston face 74 collides with the end of the cavity bottom face 48, thus delivering an impact. While the piston was traveling toward the cavity bottom face, piston port 54 for a short time was aligned with annular shoulder 70 and the compressed air from the central chamber was the shut off to piston port 54 and thus to the rear chamber 64. With continuing movement of the piston toward the cavity bottom face 48, piston port 54 became in communication with head chamber 50 permitting the air pressure that was built up in the rear chamber 64 to be released into the atmosphere through passage 56 in the piston, to the head chamber 50, and finally out housing exhaust port 72. With the piston in this front most position illustrated in FIG. 3 and the air pressure released out of the rear chamber, the air pressure in the central chamber will press against the piston step end face 67 and together with an impacting recoil shift the piston back to the rearward position illustrated in FIG. 2. With the piston in this rearward position, piston port 54 is now in communication with central chamber 68 and air pressure from housing intake port 52. The air pressure will now again build in rear chamber 64 through passage 56 and the process is repeated, thus oscillating the piston.

Figure 4:
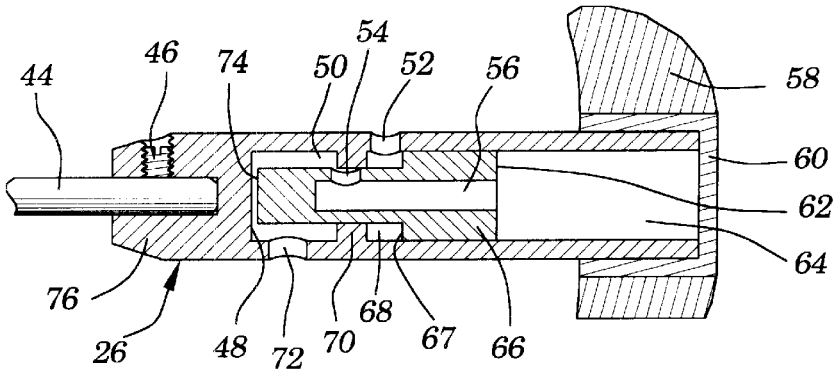
FIG. 4 is the same view as FIG. 3, differing in that the piston is occupying not quite the extreme forward position.
Figure 5:
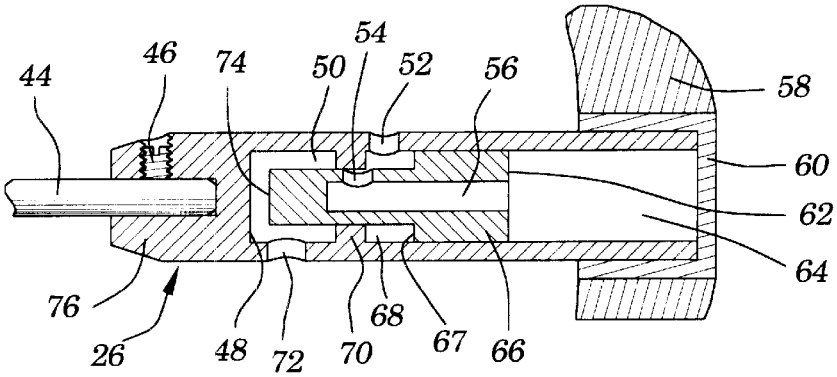
FIG. 5 is the same view as FIG. 4, differing in that the piston is occupying a slight rearward position.

Illustrations FIG. 4 and FIG. 5 depict the idling ready-state of the impact handpiece. This idling state is similar to what is described above except the piston oscillates with a very short movement stroke and without the front piston face 74 colliding or impacting with the cavity bottom face 48. This idling state can be achieved with very short movement strokes because piston port 54 is the same width as the annular shoulder 70. With this configuration the piston port 54 can move just a few thousandths of an inch to either side from alignment with the annular shoulder 70 for receiving and exhausting sufficient air pressure to oscillate the piston. The air pressure and air flow required for this idling oscillation are very low. FIG. 4 depicts the idling state with the piston shifted to the front position and the piston port 54 in communication with head chamber 50. FIG. 5 illustrates the idling state with the piston shifted to the rear position and piston port 54 in communication with central chamber 68.

Referring to FIG. 1, the hand operated pressure regulator assembly 20, the foot-operated flow control valve assembly 22, the second flow valve 25, and the idle flow valve 24 operate together supplying the needed airflow to the handpiece as follows. With an air compressor or the like supplying air pressure through the supply line 28, the hand-operated pressure regulator 20 is adjusted to the desired pressure by turning knob 21 and viewing pressure gauge 30. The second flow valve 25 is adjusted while the user fully holds down the pedal of the foot-operated flow control valve assembly 22. The second flow valve 25 is adjusted in this manner so that the user may listen to the impacts of the handpiece and set the second flow valve 25 so that the handpiece 26 is impacting no harder than the user deems necessary for the work at hand. In using a preliminary setting of the valve in this manner, the user will have full movement of the pedal to permit the handpiece to stay within the impact range the user will be utilizing. With the second flow valve 25 set, the user releases the pedal and proceeds to set the handpiece idle oscillation state by adjusting the idle flow valve 24 to permit a fine flow of air between the distribution line 32, delivery line 38, the reduced diameter delivery line 40 and finally to the handpiece 26. Because the foot-operated flow control valve assembly 22 is not depressed the plunger 106 (FIG. 9) in the flow control valve 88 is also not depressed, thus a flow of air is not only permitted to oscillate the handpiece piston but also is permitted to flow in another path to the atmosphere through the second flow valve 25 and to the flow control valve 88 (FIG. 9) and through chamber 112 (FIG. 9) to the atmosphere. Even though this leaking through the system is less efficient in air consumption during the piston idling state, it has a positive result of making it easier to set the idle to a very faint oscillation with the idle flow valve 24 (FIG. 1). In setting the tool oscillation for this extremely fine idling state, the idle flow valve 24 is easier and less critical in its adjustment to set with the venting than without.

Referring to FIG. 1, with the piston now oscillating in the idling state the handpiece 26 is now ready for impact operation. The user places the idling impact tool's graver or tool tip onto the work and slowly depresses the pedal of the foot-operated flow control valve assembly 22. The piston in the handpiece will begin delivering light impacts. As the user continues to depress the foot pedal, thus increasing air pressure to the handpiece, the piston will deliver harder and harder impacts. When the user has finished an engraving or stone setting operation he or she releases the foot pedal. With the permitted venting through chamber 112 (FIGS. 8–9) to the atmosphere when the foot operated flow control valve assembly 22 is released, this trapped air pressure will vent quickly to the atmosphere causing the impacting handpiece to stop impacting and return to the idling ready state quickly. Without this venting of residual air pressure in these lines through the exhaust in the foot-operated flow control valve, the impacting handpiece piston will lag behind the released foot pedal and continue to impact until the air pressure has dissipated through the handpiece.

Second Embodiment

Figure 10:
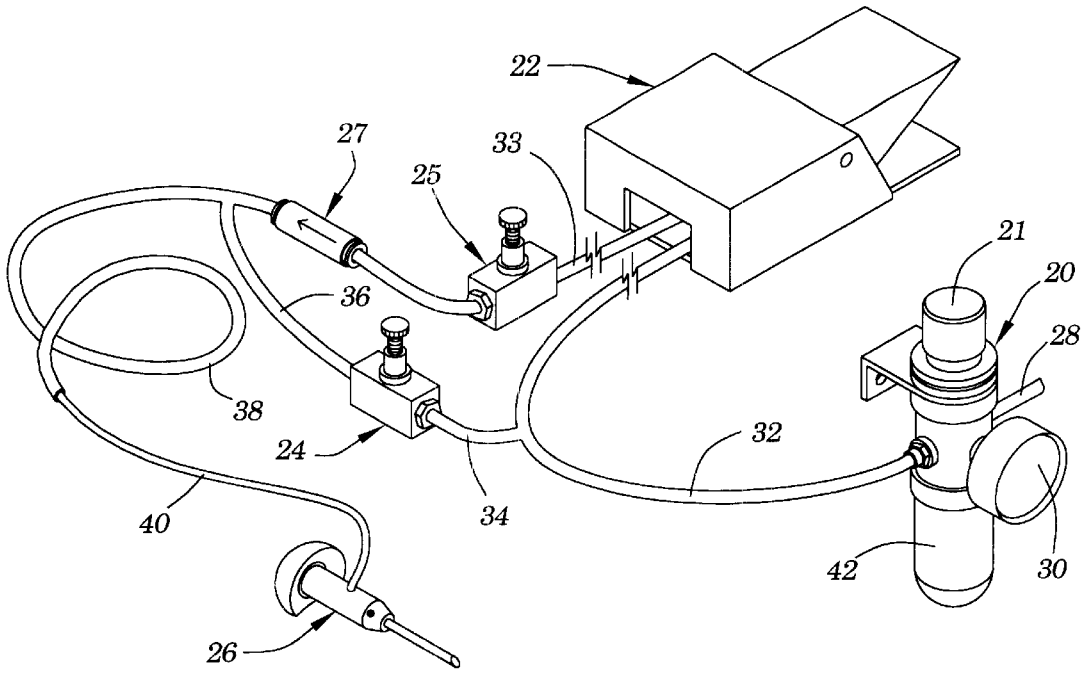
FIG. 10 is a perspective view of a second control apparatus for a hand-held pneumatic impact tool in accordance with the present invention.

The second embodiment of the control apparatus for a hand-held pneumatic impact tool is similar to the preferred embodiment with one difference. Referring to FIG. 10 a check valve 27 has been included in the apparatus. This check valve will permit air flow in one direction but not the other direction. The check valve is placed into line 38 in an orientation that air flow can only flow through it in a direction towards the handpiece. In this configuration the idling air flow into delivery line 38 from idle flow valve 24 will only flow towards the handpiece and will be blocked from venting out of the foot-operated flow control valve assembly 22. This has a positive effect of being more efficient in the amount of air required to oscillate the idling piston. Also, with this configuration the handpiece impacting will be permitted to stop impacting reasonable quickly because only the residual air pressure from the check valve 27 to the handpiece will vent through the handpiece when the foot valve is released. The residual air pressure between the check valve 27 to the foot valve will vent to the atmosphere through the foot-operated flow control valve assembly 22.

Third Embodiment

The third embodiment of the control apparatus for a hand-held pneumatic impact tool is similar to the second embodiment with one difference. Referring to FIG. 10 the second flow valve 25 is eliminated and not used in this third embodiment. In this configuration the hand operated pressure regulator assembly 20 is used to adjust the maximum pressure and flow rate that the user desires to be made available to the handpiece for the particular work at hand. In the preferred and second embodiments, the second flow valve 25 is used to adjust the maximum flow rate desired to the handpiece and the hand operated pressure regulator assembly 20 is kept at a constant higher pressure. The check valve 27 in this third embodiment will function in the same manner in the apparatus as it does in the second embodiment, as will the venting through the foot-operated flow control valve assembly 22 when the user releases the pedal.

Conclusion, Ramifications, and Scope

Accordingly, the reader will see that the control apparatus for a hand-held pneumatic impact tool provides superb control for the individual needs of the engraver or jeweler. The invention provides for handpiece impacts to be responsive and quick reacting with the foot control. The apparatus provides ease of use for setting the idling to extremely fine piston oscillation, as this is critical to fine work. It is also crucial for the engraver or jeweler be able to place the tool tip down to the work while the tool is running in a ready-state without excessive vibration in the tool or tool tip. The apparatus provides for jewelers who wish it for stone setting and hand engraving or wood carvers who will find the tool and apparatus superb for their work.

Furthermore, the invention has additional advantages in that:

- it provides control for a hand-held impact tool that will quickly stop impacting and quickly return to its idling state when the foot pedal is released;
- it provides control for a hand-held impact tool in which the piston that once oscillating in the idling ready-state is easily adjusted for very fine idling oscillation;
- it provides control for a hand-held impact tool with excellent control of fine impacts for use in extremely fine hand engraving;
- it provides control for a hand-held impact tool that does not vibrate excessively, allowing the user to set and position the graver into the work with confidence.

Although the invention has been described with reference to the illustrations, it should be noted that substitutions may be made and equivalents employed herein. For example:

- one or more shut off valves may be included in line 28, 32, 33, 34, 36, or 38 (FIG. 1) for shutting off the apparatus when not in use;
- one or more pressure gauges for visually monitoring pressure in the system may be included in line 33, 36, or 38;
- the exhaust in flow control valve 88 (FIG. 9) that is only utilized when the foot pedal is released may be substituted for a valve that exhausts full time and that is not governed by the pedal movement;
- a substitute to the exhaust incorporated in the flow control valve 88 (FIG. 9) may be placed anywhere in lines 33, 38, or 36;
- more than one handpiece can be attached to the control apparatus by adding an automatic or manual switching device in line 38 for the user to select the handpiece he or she desires to use. The two flow valves 24 and 25 (FIG. 1 and FIG. 10) may be used alone with a system such as this or additional flow valves may be added for each additional handpiece. The same is true for check valve 27 (FIG. 10), additional check valves may also be added for each additional handpiece.
- more than one check valve may be utilized and placed within lines 33, 38 or 40 (FIGS. 1 and 10), including a check valve which may be inserted in line 38 or 40 on the handpiece side where spliced line 36 meets line 38.

Another example is a number of the components illustrated in FIGS. 1 and 10 may all be placed into a box with holes employed for protruding knobs, handles and/or pressure gauges. The components that may be include in a box include the hand operated pressure regulator assembly 20, idle flow valve 24, the second flow valve 25, check valve 27 and some of the air lines.

Accordingly, the scope of the invention should be determined not by the embodiments illustrated, but by the appended claims and their legal equivalents.

I claim:

1. A handheld pneumatic power tool apparatus for use with a supply of pressurized air, the apparatus comprising:

- a handpiece having a first end and a second end;
- a cylindrical cavity within said handpiece, the cylindrical cavity having a central longitudinal axis;
- a piston received in said cylindrical cavity and being shiftable relative to said handpiece along said central longitudinal axis;
- an oscillation means by which said piston will oscillate back and forth a distance within said cylindrical cavity and along said central longitudinal axis under the action of said supply of pressurized air;

a first air flow delivery means for delivering air flow to said handpiece, said first air flow delivery means including a foot-operated air flow valve that includes an inlet port in communication with supply of pressurized air and an outlet port in communication to said handpiece;

said foot-operated air flow valve is movable between an off position in which the air flowing through said foot-operated air flow valve is zero and a number of on positions;

a second adjustable air flow delivery means for delivering air flow to said handpiece to permit said oscillation means to function when said foot operated air flow valve is in the off, zero flow position;

said second adjustable air flow delivery means includes an additional flow control valve in communication with said supply of pressurized air and said handpiece;

said additional flow control valve is adjustable between an off position in which the air flow is zero and a number of on positions;

said second adjustable air flow delivery means is independent from said first air flow delivery means and is not adjusted by said foot-operated air flow valve;

a manual means for the user of the said handheld pneumatic power tool apparatus to manually adjust said second adjustable air flow delivery means, and an idle-impact means for said piston to oscillate without delivering collision impacts against said first end and for said piston to oscillate with varying amount of impact collision energy against said first end.

2. A handheld pneumatic power tool apparatus as recited in claim 1, further comprising:

a pressure venting means in communication with said outlet port for venting air pressure to the atmosphere when said foot-operated air flow valve is in the off position.

3. A handheld pneumatic power tool apparatus as recited in claim 1, wherein during operation by the user of said handheld pneumatic power tool apparatus said handpiece is brought to the work that the user wants to use the power tool on while said oscillation means is functioning but without said piston delivering collision impacts with said first end.

4. A handheld pneumatic power tool apparatus as recited in claim 1, further comprising:

a third manually adjustable flow control valve in communication with said outlet port, said additional flow control valve, and said handpiece.

5. A handheld pneumatic power tool apparatus as recited in claim 1, comprising:

at least one checked air flow means for permitting greater air flow in one direction more than in the other direction, and;

said at least one checked air flow means in communication with said handpiece and said additional flow control valve.

* * * * *